US009253578B2

(12) United States Patent
Konno et al.

(10) Patent No.: US 9,253,578 B2
(45) Date of Patent: Feb. 2, 2016

(54) DIRECTIONAL LOUDSPEAKER

(75) Inventors: Fumiyasu Konno, Osaka (JP); Katsu Takeda, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/237,481

(22) PCT Filed: Aug. 28, 2012

(86) PCT No.: PCT/JP2012/005396

§ 371 (c)(1),
(2), (4) Date: Feb. 6, 2014

(87) PCT Pub. No.: WO2013/042316

PCT Pub. Date: Mar. 28, 2013

(65) Prior Publication Data

US 2014/0153750 A1 Jun. 5, 2014

(30) Foreign Application Priority Data

Sep. 22, 2011 (JP) ..... 2011-206921

(51) Int. Cl.

| | |
|---|---|
| ***H04R 17/00*** | (2006.01) |
| ***H04R 1/32*** | (2006.01) |
| ***H04R 7/20*** | (2006.01) |
| *H04R 1/40* | (2006.01) |

(52) U.S. Cl.

CPC ..... *H04R 17/00* (2013.01); *H04R 1/323* (2013.01); *H04R 7/20* (2013.01); *H04R 1/403* (2013.01); *H04R 2307/027* (2013.01); *H04R 2307/204* (2013.01); *H04R 2307/207* (2013.01)

(58) Field of Classification Search

CPC .... H04R 17/00; H04R 2499/11; H04R 17/20; H04R 17/18; H04R 17/04

USPC ..... 381/190, 426, 398; 310/328

See application file for complete search history.

(56) References Cited

U.S. PATENT DOCUMENTS

| | | | |
|---|---|---|---|
| 4,638,207 | A | 1/1987 | Radice |
| 6,889,550 | B2 | 5/2005 | Beitia |
| 7,009,326 | B1 | 3/2006 | Matsuo et al. |
| 2003/0099371 | A1 | 5/2003 | Ogura et al. |
| 2003/0122454 | A1 | 7/2003 | Omata et al. |

(Continued)

FOREIGN PATENT DOCUMENTS

| | | | |
|---|---|---|---|
| EP | 2373057 | A1 | 10/2011 |
| JP | 36-17557 | | 9/1961 |

(Continued)

OTHER PUBLICATIONS

International Search Report issued in International Application No. PCT/JP2012/005396 mailed Dec. 4, 2012, 4 pgs.

(Continued)

*Primary Examiner* — Rasha Al Aubaidi

(74) *Attorney, Agent, or Firm* — McDermott Will & Emery LLP

(57) ABSTRACT

In a directional loudspeaker, an audible sound signal that is modulated with a carrier wave in the ultrasonic wave band is input to a piezoelectric element, and thereby a diaphragm having the piezoelectric element is vibrated and a sound wave is generated. In such a directional loudspeaker, the diaphragm is fixed to a fixed part via a plurality of beams disposed along the outer circumference of the diaphragm.

20 Claims, 12 Drawing Sheets

(56) References Cited

U.S. PATENT DOCUMENTS

| | | | | |
|---|---|---|---|---|
| 2004/0209654 | A1* | 10/2004 | Cheung et al. | 455/567 |
| 2006/0159295 | A1 | 7/2006 | Onishi et al. | |
| 2012/0057730 | A1* | 3/2012 | Fujise et al. | 381/190 |
| 2012/0119617 | A1 | 5/2012 | Takahashi et al. | |
| 2012/0140969 | A1* | 6/2012 | Fujise et al. | 381/190 |

FOREIGN PATENT DOCUMENTS

| | | | |
|---|---|---|---|
| JP | 36-17558 | | 9/1961 |
| JP | 55-104892 | U | 7/1980 |
| JP | 58-157293 | A | 9/1983 |
| JP | 59-11600 | U | 1/1984 |
| JP | 63-65393 | U | 4/1988 |
| JP | 09-284897 | A | 10/1997 |
| JP | 2000-350293 | A | 12/2000 |
| JP | 2001-197594 | A | 7/2001 |
| JP | 2006-245731 | A | 9/2006 |
| JP | 2007-104650 | A | 4/2007 |
| JP | 2007-129384 | A | 5/2007 |
| JP | 2010-157886 | A | 7/2010 |
| JP | 2012-134599 | A | 7/2012 |
| WO | 02/103294 | A1 | 12/2002 |
| WO | 2010/074206 | A1 | 7/2010 |
| WO | 2010/131540 | | 11/2010 |

OTHER PUBLICATIONS

The Extended European Search Report dated Aug. 7, 2015 for the related European Patent Application No. 12833078.4.
The Extended European Search Report dated Feb. 20, 2015 for the related European Patent Application No. 12833078.4.

* cited by examiner

DIRECTIONAL LOUDSPEAKER

RELATED APLICATIONS

This application is the U.S. National Phase under 35 U.S.C. §371 of International Application No. PCT/JP2012/005396, filed on Aug. 28, 2012, which in turn claims the benefit of Japanese Application No. 2011-206921, filed on Sep. 22, 2011, the disclosures of which are incorporated by reference herein.

TECHNICAL FIELD

The present invention relates to a directional loudspeaker that allows transmission of audio information only to a specific subject.

BACKGROUND ART

In order to transmit audio information only to a specific subject, a directional loudspeaker has conventionally been used. In the directional loudspeaker, an audible sound signal as audio information that is modulated with a carrier wave in the ultrasonic wave band is input to a piezoelectric element, and thereby a diaphragm provided with the piezoelectric element is vibrated and a sound wave is generated. A structural sectional view of this directional loudspeaker is shown in FIG. 12.

Piezoelectric element 105 as a vibration source adheres to diaphragm 103 of directional loudspeaker 101. Diaphragm 103 is bonded, using insulating adhesive agent 111, to the tips of electrodes 109 that are fixed to base 107. Further, piezoelectric element 105 is connected to each of electrodes 109 via respective lead wire 113. In order to increase the sound pressure from directional loudspeaker 101, directional loudspeaker 101 may include resonator 115 (see Patent Literature 1, for example).

With such a configuration, a signal obtained by modulating an audible sound signal with a carrier wave in the ultrasonic wave band is input from an external electrical circuit (not shown) to piezoelectric element 105 via electrodes 109 and lead wires 113. Thereby, piezoelectric element 105 and diaphragm 103 are vibrated, and audio information is transmitted only to a specific subject, i.e. the user of the electronic device, for example.

CITATION LIST

Patent Literature 1 Japanese Patent Unexamined Publication No. 2006-245731

SUMMARY OF THE INVENTION

The present invention provides a directional loudspeaker. In this directional loudspeaker, an audible sound signal that is modulated with a carrier wave in the ultrasonic wave band is input to a piezoelectric element, and thereby a diaphragm having the piezoelectric element is vibrated and a sound wave is generated. In this directional loudspeaker, the diaphragm is fixed to a fixed part via a plurality of beams disposed along the outer circumference of the diaphragm.

DESCRIPTION OF EMBODIMENTS

Figure 12:
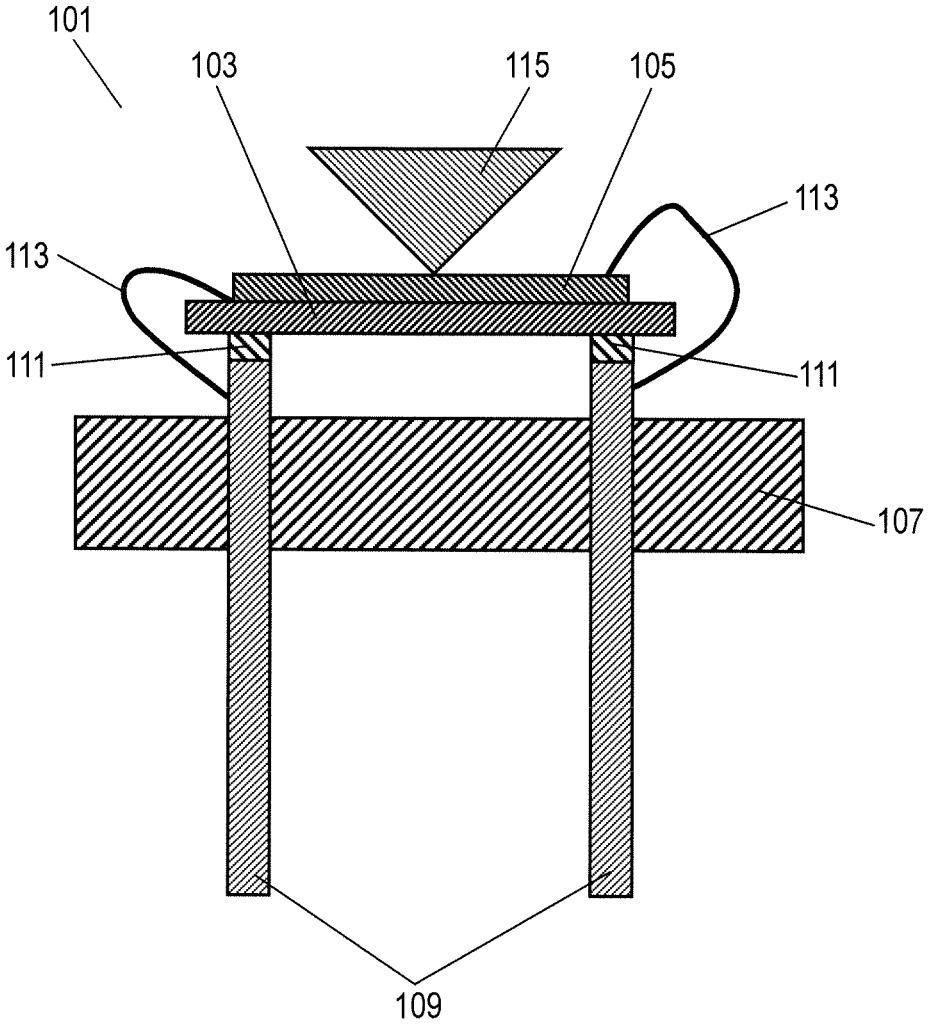
FIG. 12 PRIOR ART
FIG. 12 is a sectional view of a conventional directional loudspeaker.

Prior to the description of the exemplary embodiments of the present invention, a problem in the conventional configuration shown in FIG. 12 is described.

In directional loudspeaker 101 shown in FIG. 12, diaphragm 103 that has piezoelectric element 105 adhering thereto is bonded to the tips of electrodes 109, using insulating adhesive agent 111. Thus, the circumference of diaphragm 103 is a free end. In addition, insulating adhesive agent 111 has a low rigidity. Thus, when a signal is input to piezoelectric element 105, diaphragm 103 vibrates in the vertical direction in FIG. 12 with the parts bonded using insulating adhesive agent 111 as nodes thereof. In other words, when the portion of diaphragm 103 between electrodes 109 bends downward, the free end bends upward. When the portion of diaphragm 103 between electrodes 109 bends upward, the free end bends downward. These operations generate the sound wave. However, the vibration of diaphragm 103 exerts repeated stresses on insulating adhesive agent 111. If the degradation of insulating adhesive agent 111 is advanced in such a state by the influence of an ambient temperature, humidity, or the like, diaphragm 103 can peel off from the tips of electrodes 109.

In contrast, if bonding is made with a more rigid material including metal bonding, instead of insulating adhesive agent 111, the possibility of peeling-off is reduced. However, the free end is less likely to vibrate and this reduces the sound pressure.

Hereinafter, a description is provided for the exemplary embodiments of the present invention that address the above problem, with reference to the accompanying drawings.

First Exemplary Embodiment

Figure 1:
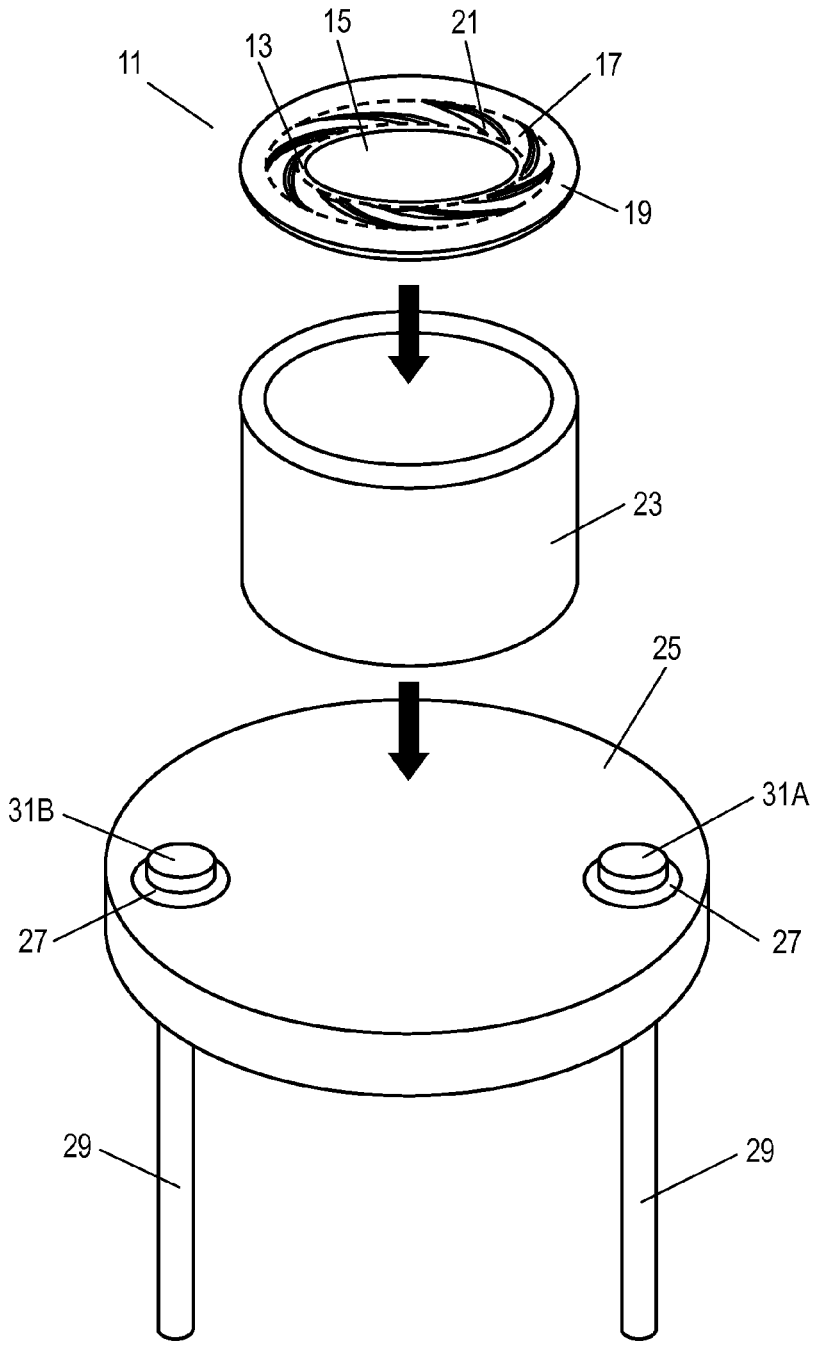
FIG. 1 is an exploded perspective view of a directional loudspeaker in accordance with a first exemplary embodiment of the present invention.
Figure 2A:
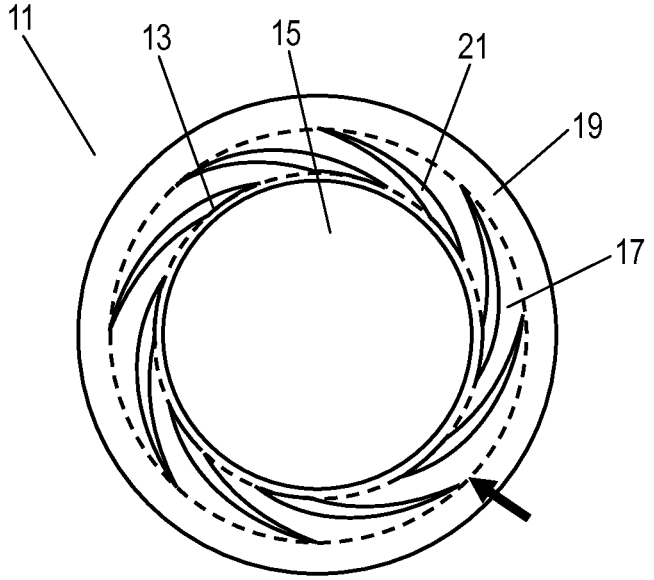
FIG. 2A is a top view of a vibrator of the directional loudspeaker in accordance with the first exemplary embodiment.
Figure 2B:
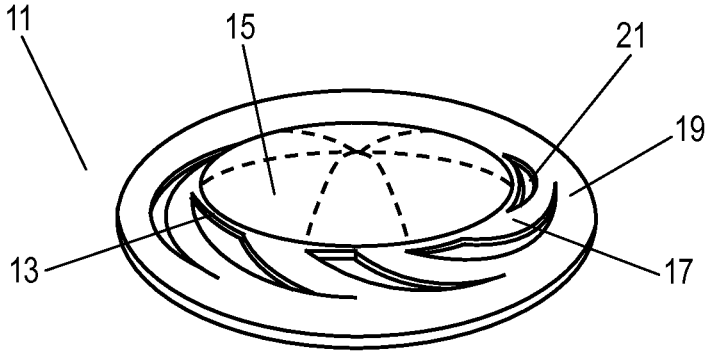
FIG. 2B is a perspective view of the vibrator of the directional loudspeaker in vibration in accordance with the first exemplary embodiment.
Figure 3:
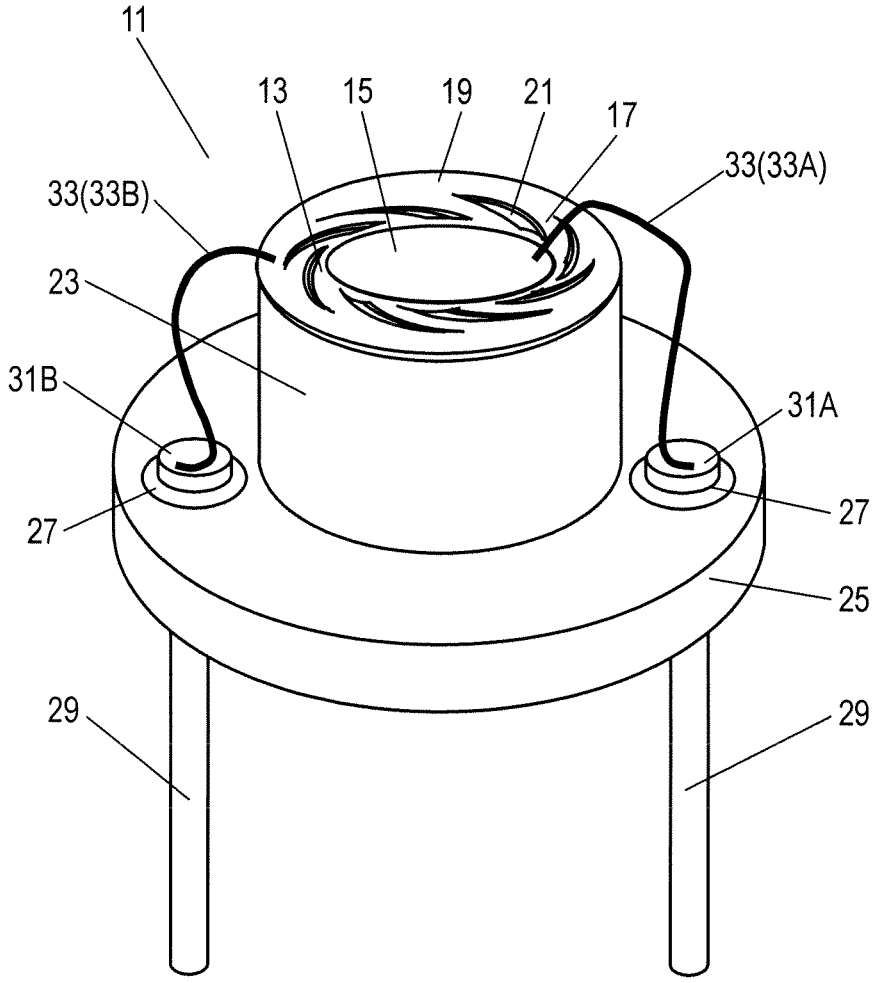
FIG. 3 is an assembly perspective view of the directional loudspeaker in accordance with the first exemplary embodiment.
Figure 4:
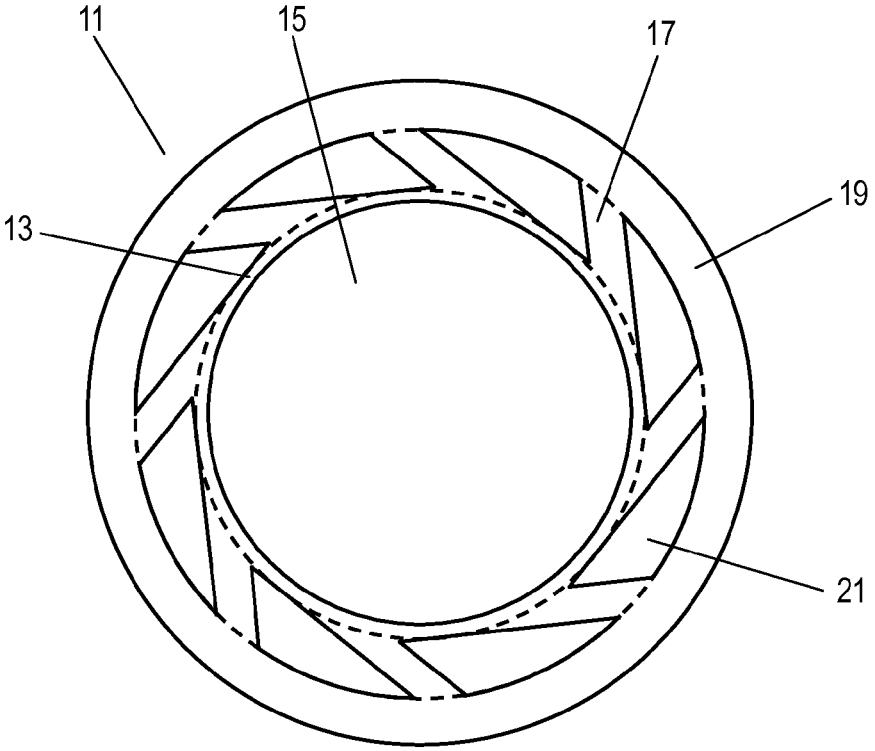
FIG. 4 is a top view of another configuration of the vibrator of the directional loudspeaker in accordance with the first exemplary embodiment.
Figure 5:
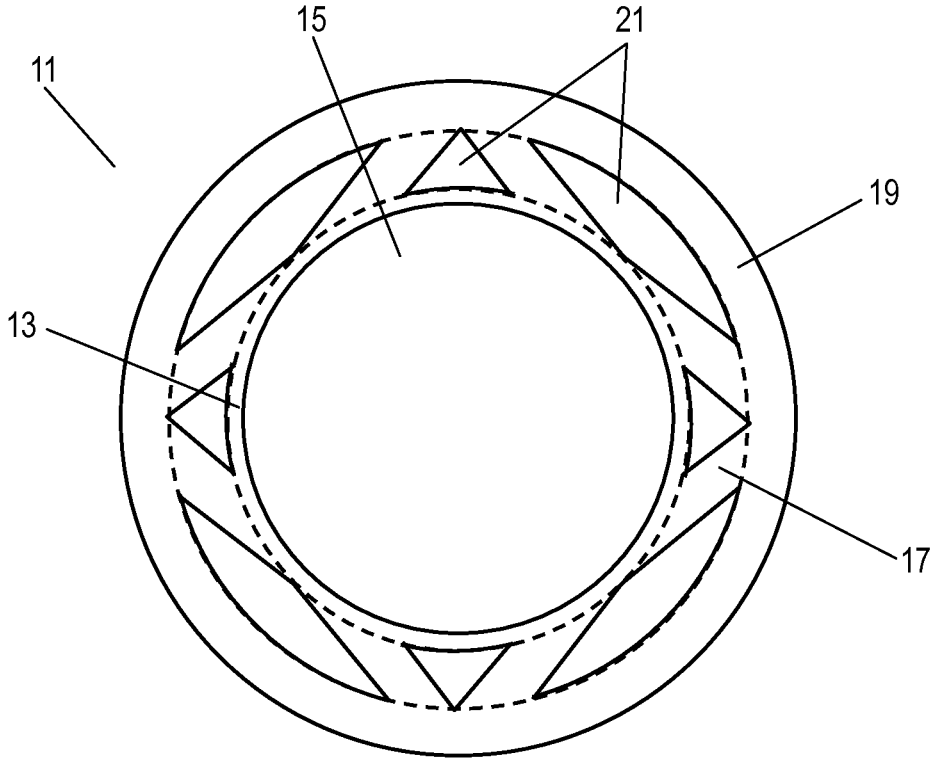
FIG. 5 is a top view of still another configuration of the vibrator of the directional loudspeaker in accordance with the first exemplary embodiment.
Figure 6:
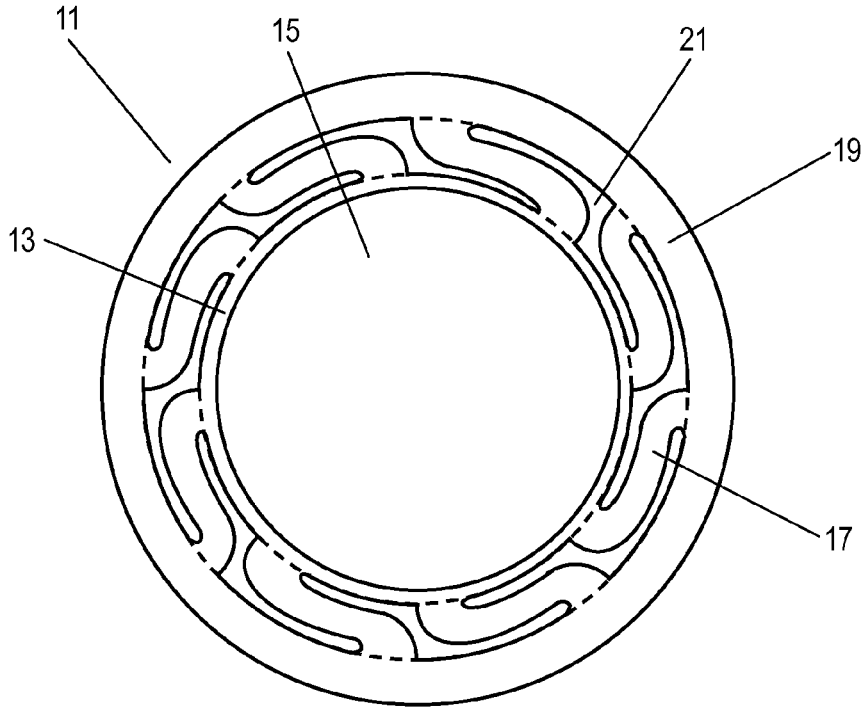
FIG. 6 is a top view of yet another configuration of the vibrator of the directional loudspeaker in accordance with the first exemplary embodiment.

FIG. 1 is an exploded perspective view of a directional loudspeaker in accordance with the first exemplary embodiment of the present invention. FIG. 2A is a top view of a vibrator of the directional loudspeaker in accordance with the first exemplary embodiment. FIG. 2B is a perspective view of the vibrator of the directional loudspeaker in vibration in accordance with the first exemplary embodiment. FIG. 3 is an assembly perspective view of the directional loudspeaker in accordance with the first exemplary embodiment. Each of FIG. 4 through FIG. 6 is a top view of another configuration of the vibrator of the directional loudspeaker in accordance with the first exemplary embodiment.

As shown in FIG. 1, the directional loudspeaker includes vibrator 11, support 23, and base 25. Vibrator 11 is formed of disc-shaped diaphragm 13, piezoelectric element 15, a plurality of beams 17, and fixed part 19. The gap between adjacent beams 17 is referred to as slit 21. It is defined that diaphragm 13 is within the circular region shown by the inner fine dotted line in vibrator 11 in FIG. 1 and fixed part 19 extends in the region from the circle shown by the outer fine dotted line to the outermost circumference in vibrator 11 in FIG. 1.

Here, a plurality of (eight in FIG. 1) beams 17 are present, and the beams are disposed in at least part of the outer circumference of diaphragm 13 along the outer circumference of diaphragm 13. Beams 17 extend in the plane direction of diaphragm 13, that is, the direction the same as that of the plane of diaphragm 13.

The other end of each beam 17 is fixed to fixed part 19. Specifically, diaphragm 13, beams 17, and fixed part 19 are integrally formed by pressing a metal plate made of aluminum, for example. This configuration strengthens the connection between diaphragm 13 and beams 17, and between beams 17 and fixed part 19, and eliminates the need for an insulating adhesive agent or the like. Thus, no peeling-off occurs and the reliability is enhanced. The integrally forming method is not limited to pressing, and etching may be used. In this case, small beams 17 or those having complicated shapes can be worked with a high accuracy.

Piezoelectric element 15 is formed on the top face of diaphragm 13 thus obtained. As shown in FIG. 2A, piezoelectric element 15 is shaped into a circle with a diameter slightly smaller than that of diaphragm 13.

Now, beams 17 are described in detail. Beams 17 securely retains diaphragm 13 so that high reliability is obtained. Further, when diaphragm 13 is vibrated by inputting a signal to piezoelectric element 15, beams 17 also bend, which enhances the displacement of diaphragm 13. That is, beams 17 serve to increase the sound pressure. Thus, the presence of beams 17 can enhance the displacement of diaphragm 13. In order to effectively enhance the displacement, in this exemplary embodiment, the length of each beam 17 is set longer than the gap, i.e. the minimum distance, between diaphragm 13 and fixed part 19,. For this purpose, as shown in FIG. 2A, beams 17 are formed in a helical shape from diaphragm 13 to fixed part 19 in an oblique direction. This configuration can lengthen each beam 17 and allows beams 17 to displace diaphragm 13 in a twisted direction. Thus, the entire displacement can be enhanced. When the sound pressure is higher than necessary, the sound pressure can be adjusted by changing the angle of each beam 17, disposing each beam 17 at the minimum distance between diaphragm 13 and fixed part 19, or the like.

Next, a perspective view when vibrator 11 is driven is shown in FIG. 2B. In the drawing, expansion of diaphragm 13 and piezoelectric element 15, and bend of beams 17 are exaggerated compared to actual behaviors. As shown in the drawing, in response to expansion of diaphragm 13 upward in FIG. 2B, beams 17 also bend upward. As a result, the displacement of diaphragm 13 caused by the bend of beams 17 is enhanced and thereby high sound pressure is obtained.

Beams 17 also have the following advantages. In beams 17, the distance between the portions of adjacent beams 17 fixed to fixed part 19, i.e. the width of slit 21 at fixed part 19 shown by the arrow in FIG. 2A, is substantially zero within a fixing accuracy of each beam 17 to fixed part 19. The fixing accuracy means the working accuracy in pressing or etching.

As shown in FIG. 2A, such a shape of beams 17 means that the shape of each slit 21 has a portion along the outer circumference (inner dotted line in FIG. 2A) of diaphragm 13 on the side of diaphragm 13 but has no portion along the inner circumference (outer dotted line in FIG. 2A) of fixed part 19.

With this configuration, substantially no slit 21 is present with respect to fixed part 19, and the rigidity of beams 17 at fixed part 19 can be enhanced. Therefore, even when the vibration of diaphragm 13 repeatedly bends beams 17, this configuration can reduce the possibility of breakage of beams 17 at fixed part 19 and thus further enhance the reliability.

The specific shapes of beams 17 vary with materials and thicknesses of beams 17, characteristics of input signals, required reliability and sound pressure, or the like. Thus, it is only necessary to determine the shape appropriately via simulations, trials, or the like.

Returning to FIG. 1, vibrator 11 thus configured is fixed to one end of support 23 at fixed part 19. Support 23 is made of a metal and shaped into a cylinder. As substantially no vibration of diaphragm 13 is conveyed to fixed part 19 the possibility of decreasing sound pressure is extremely low even when fixed part 19 is securely fixed to support 23. Therefore, in order to obtain high reliability, fixed part 19 is welded to support 23. The fixing of fixed part 19 to support 23 is not limited to welding, and may include soldering, and an adhesive agent that ensures high reliability.

The other end of support 23 is fixed to metallic disc-shaped base 25. Examples of the method for fixing the support and the base include welding and adhesion as described above. To base 25, two electrodes 29 are fixed via insulators 27. Two electrodes 29 penetrate base 25. Terminals 31A and 31B are formed by flattening the tips of electrodes 29 on the base 25 side. Examples of such base 25 include the base portion of the metal package in a commercially-available metallic case (can).

A perspective view of a directional loudspeaker thus assembled is shown in FIG. 3. Lead wire 33A is joined to the surface of piezoelectric element 15. The other end of lead wire 33A is connected to terminal 31A. Piezoelectric element 15 is formed on the top face of metallic diaphragm 13. Thus, the rear face of piezoelectric element 15 (the face in contact with diaphragm 13) is electrically connected to fixed part 19 via beams 17. Therefore, one end of lead wire 33B is connected to fixed part 19 where the influence of vibration of diaphragm 13 is extremely small. The other end of lead wire 33B is connected to terminal 31B. These connections are made by wire bonding. The connection is not limited to wire bonding, and any configuration that does not seriously hinder the vibration of diaphragm 13 can be used. Examples of such a configuration include the use of flexible cables as lead wires 33A and 33B, or the use of both wire and flexible cable.

With this configuration, a signal can be input from electrodes 29 to piezoelectric element 15. That is, diaphragm 13 provided with piezoelectric element 15 can be vibrated by inputting a signal obtained by modulating an audible sound signal with a carrier wave in the ultrasonic wave band. As a result, a highly-directional sound wave is generated, and thus sound information can be transmitted only to a specific subject.

The above configuration and operation allow diaphragm 13 to be retained by beams 17 disposed in at least part of the outer circumference of diaphragm 13 and thus eliminate the need for the use of the conventional insulating adhesive agent. This makes diaphragm 13 less likely to be affected by an ambient temperature, humidity, or the like, and offers high reliability. Further, the bend of beams 17 allows the vibration of entire diaphragm 13 even through diaphragm 13 is retained by beams 17, and thus high sound pressure is obtained. Therefore, this configuration allows a directional loudspeaker with high sound pressure to have high reliability.

This exemplary embodiment shows a configuration of integrally forming diaphragm 13, beams 17, and fixed part 19. However, each element may be formed separately. That is, these elements are formed separately, and diaphragm 13 is securely fixed to one ends of beams 17, and the other ends of beams 17 are securely fixed to fixed part 19 by welding, soldering, adhesion, or the like. With this configuration, individual elements are made of different materials and thus optimum design can be made. For instance, diaphragm 13 is made of a material having a high degree of adhesion to piezoelectric element 15, beams 17 are made of a flexible material, and fixed part 19 is made of a material having a high rigidity. When diaphragm 13, beams 17, and fixed part 19 are integrally formed of the same material, the reliability or sound pressure optimum for input signal characteristics may not be obtained in some cases. In that case, elements made of different materials can configure a directional loudspeaker that has both high reliability and high sound pressure.

In this exemplary embodiment, piezoelectric element 15 is formed only on the top face of diaphragm 13. However, even piezoelectric element 15 is formed on the bottom face (rear face) of diaphragm 13, the advantages (high reliability and high sound pressure) can be offered similar to those when the piezoelectric element is formed on the top face.

Further, piezoelectric elements 15 may be formed on both faces of diaphragm 13, or a plurality of piezoelectric elements 15 may be laminated so that polarization directions thereof are different. When piezoelectric elements 15 are formed in this manner, electrically parallel connection can lower the voltage at which the equal sound pressure can be obtained and simplify the circuit configuration. In this configuration, the sound pressure can be increased by application of the equal voltage. In this manner, forming piezoelectric elements 15 can offer the advantages of reducing the cost with the simplified circuit and further increasing the sound pressure, in addition to the advantages of high reliability and high sound pressure in the present exemplary embodiment.

In order to further increase the sound pressure, piezoelectric element 15 may include a resonator in the conventional configuration shown in FIG. 12. However, the positions of lead wires 33 need to be considered so that the resonator does not make contact with lead wires 33.

In the exemplary embodiment, each of beams 17 is in a helical shape extending from diaphragm 13 to fixed part 19, but is not limited to this shape. For instance, as shown in the top view of vibrator 11 in FIG. 4, beams 17 may be formed as straight lines. In this case, the shape of each slit 21 is simplified and thus the accuracy is ensured even by pressing. Therefore, this configuration can reduce the cost, in addition to the advantages of high reliability and high sound pressure.

In the configuration of FIG. 4, each slit 21 is formed along both of the inner circumference (outer dotted line in FIG. 4) of fixed part 19 and the outer circumference (inner dotted line in FIG. 4) of diaphragm 13. That is, this slit is different in shape from slit 21 of FIG. 2A where substantially no portion is present along the inner circumference (outer dotted line in FIG. 2A) of fixed part 19. However, depending on the required reliability and sound pressure, the configuration of FIG. 4 instead of the configuration of slits 21 in FIG. 2A can reduce the cost within the range in which the reliability and sound pressure are ensured. Therefore, it is only necessary to comprehensively determine the shape of beams 17 in consideration of the cost reduction in addition to the reliability and sound pressure.

Similarly, as shown in vibrator 11 of FIG. 5, the angle of each straight beam 17 extending from vibrator 13 to fixed portion 19, with respect to vibrator 13 may be inverted alternately. In this case, slits 21 have an area larger than those in the cases shown in FIG. 2A and FIG. 4. Therefore, in addition to the advantages obtained by the configuration of FIG. 4, two lead wires 33 joined to the top face of piezoelectric element 15 and fixed part 19, respectively, can be led to the bottom face through slits 21. Thus, two terminals 31A and 31B can be disposed inside support 23 that is fixed to base 25 in FIG. 1, and thereby the directional loudspeaker can be downsized.

Further, as shown in vibrator 11 of FIG. 6, part of each beam 17 may be formed along diaphragm 13 and the circumference of fixed part 19. In this case, each beam 17 has a crank shape and thus is longer than those of the cases shown in FIG. 2A, FIG. 4, and FIG. 5. This configuration can further enhance the bend of each beam 17 when diaphragm 13 is vibrated. This configuration is effective when much higher sound pressure is necessary.

Second Exemplary Embodiment

Figure 7A:
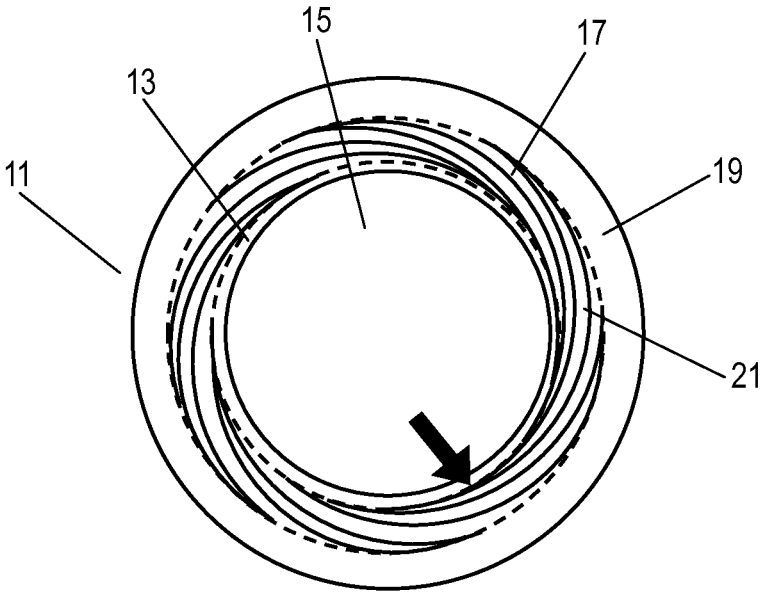
FIG. 7A is a top view of a vibrator of a directional loudspeaker in accordance with a second exemplary embodiment of the present invention.
Figure 7B:
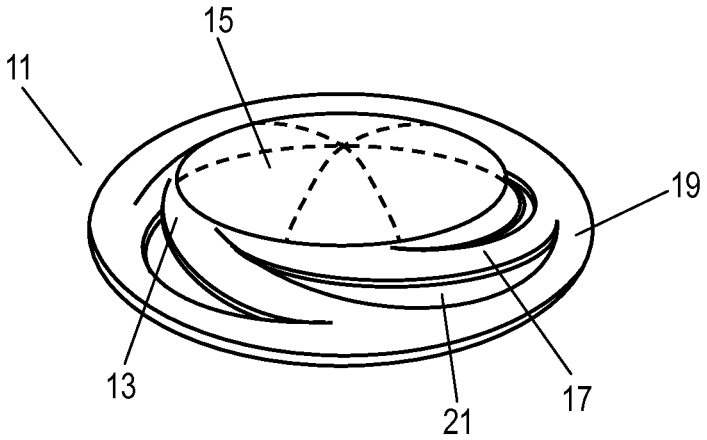
FIG. 7B is a perspective view of the vibrator of the directional loudspeaker in vibration in accordance with the second exemplary embodiment.

FIG. 7A is a top view of a vibrator of a directional loudspeaker in accordance with the second exemplary embodiment of the present invention. FIG. 7B is a perspective view of the vibrator of the directional loudspeaker in vibration in accordance with the second exemplary embodiment. In this exemplary embodiment, elements similar to those of the first exemplary embodiment have the same reference marks and the detailed description thereof may be omitted.

The characteristic configuration of this exemplary embodiment is as follows. In a plurality of beams 17, the distance between the portions of adjacent beams 17 fixed to diaphragm 13, i.e. the width of slit 21 at diaphragm 13 shown by the arrow in FIG. 7A, is substantially zero within a fixing accuracy of each beam 17 to diaphragm 13. Similarly to the first exemplary embodiment, the fixing accuracy means the working accuracy in pressing or etching.

As shown in FIG. 7A, such a shape of beams 17 means that the shape of each slit 21 has a portion along the inner circumference (outer dotted line in FIG. 7A) of fixed part 19 on the fixed part 19 side but has no portion along the outer circumference (inner dotted line in FIG. 7A) of diaphragm 13. This shape is reverse to the shape of slit 21 of FIG. 2A in the first exemplary embodiment.

With this shape, substantially no slit 21 is present with respect to diaphragm 13, and thus the rigidity of beams 17 at diaphragm 13 can be maximized. Therefore, when stresses are concentrated on the root portions of beams 17 at diaphragm 13 by the vibration of diaphragm 13 in the required driving characteristics of a directional loudspeaker, the configuration of FIG. 7A can reduce the possibility of breakage of the root portions of beams 17, thereby further enhancing the reliability. That is, as shown in FIG. 7B, when diaphragm 13 is vibrated, in response to expansion of piezoelectric element 15 and diaphragm 13 upwardly, beams 17 also bend upward. The width of each beam 17 is largest in the root portion coupled with diaphragm 13. Thus, even in the driving characteristics where stresses are concentrated on the root portions, the reliability can be enhanced.

Also in this exemplary embodiment, similarly to the first exemplary embodiment, the specific shapes of beams 17 can vary with materials and thicknesses of beams 17, characteristics of input signals, required reliability and sound pressure, or the like. Thus, it is only necessary to determine the shape appropriately via simulations, trials, or the like.

The above configuration and operation can reduce the possibility of breakage of the root portions of beams 17 at diaphragm 13 and thereby allow a directional loudspeaker with high sound pressure to have much higher reliability.

Third Exemplary Embodiment

Figure 8:
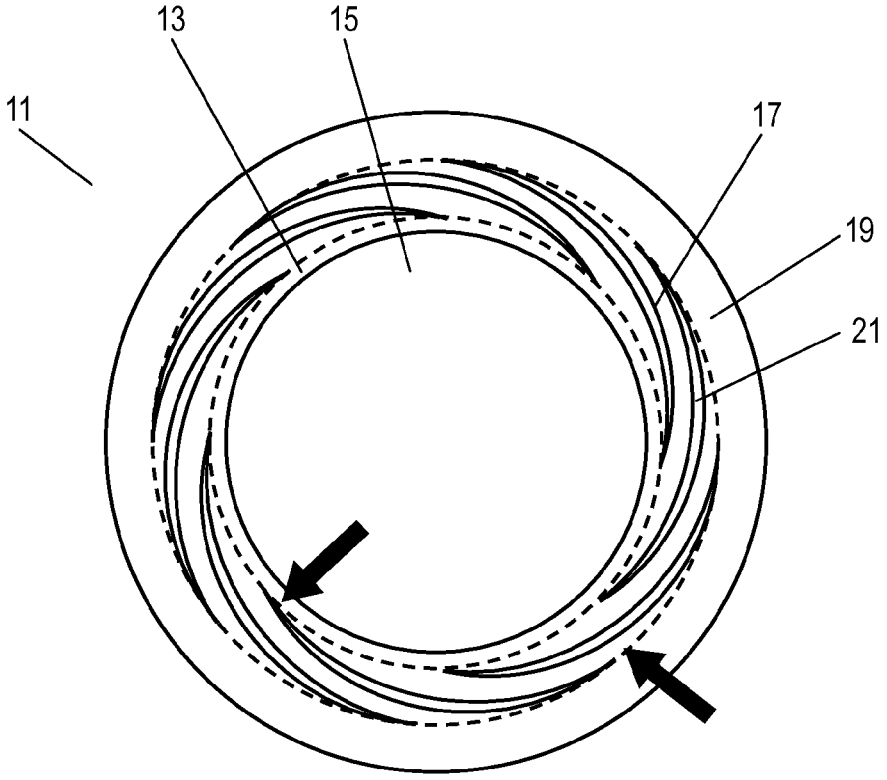
FIG. 8 is a top view of a vibrator of a directional loudspeaker in accordance with a third exemplary embodiment of the present invention.

FIG. 8 is a top view of a vibrator of a directional loudspeaker in accordance with the third exemplary embodiment of the present invention. In this exemplary embodiment, elements similar to those of the first exemplary embodiment have the same reference marks and the detailed description thereof may be omitted.

The characteristic configuration of this exemplary embodiment is as follows. In a plurality of beams 17, the distance between the portions of adjacent beams 17 fixed to fixed part 19, i.e. the width of slit 21 at fixed part 19, is substantially zero within a fixing accuracy of each beam 17 to fixed part 19. Further, in the plurality of beams 17, the distance between the portions of adjacent beams 17 fixed to diaphragm 13, i.e. the width of slit 21 at diaphragm 13, is substantially zero within a fixing accuracy of each beam 17 to diaphragm 13. In other words, the shape of beams 17 of this exemplary embodiment has both of the advantages of the first exemplary embodiment and the second exemplary embodiment. As shown by the arrows in FIG. 8, the widths of both ends of each slit 21 are substantially zero. Thus, each slit 21 has a shape that has no portion along the outer circumference (inner dotted line in FIG. 8) of diaphragm 13 and has no portion along the inner circumference (outer dotted line in FIG. 8) of fixed part 19.

With this configuration, substantially no slit 21 is present along the outer circumference of diaphragm 13 and the inner circumference of fixed part 19. This configuration can enhance the rigidity of beams 17 both at diaphragm 13 and at fixed part 19. As a result, even when beams 17 are bent repeatedly by the vibration of diaphragm 13, the possibility of breakage of the root portions of beams 17 both at diaphragm 13 and at fixed part 19 can be reduced and thereby the reliability is further enhanced.

Also in this exemplary embodiment, similarly to the first exemplary embodiment and the second exemplary embodiment, the specific shapes of beams 17 can vary with materials and thicknesses of beams 17, characteristics of input signals, required reliability and sound pressure, or the like. Thus, it is only necessary to determine the shape appropriately via simulations, trials, or the like.

The above configuration and operation can reduce the possibility of breakage of the root portions of beams 17 both at diaphragm 13 and at fixed part 19. Thus, a directional loudspeaker having high sound pressure is allowed to have much higher reliability.

Fourth Exemplary Embodiment

Figure 9A:
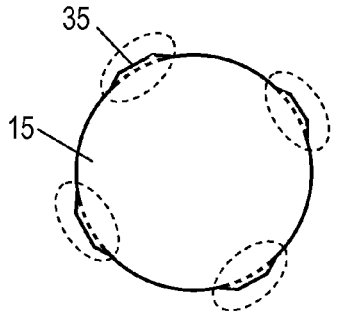
FIG. 9A is a top view of a piezoelectric element of a vibrator of a directional loudspeaker in accordance with a fourth exemplary embodiment of the present invention.
Figure 9B:
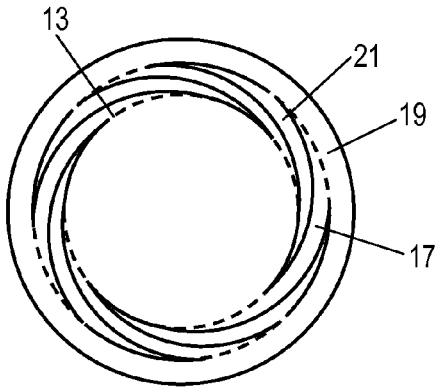
FIG. 9B is a top view of a diaphragm of the vibrator of the directional loudspeaker in accordance with the fourth exemplary embodiment.
Figure 9C:
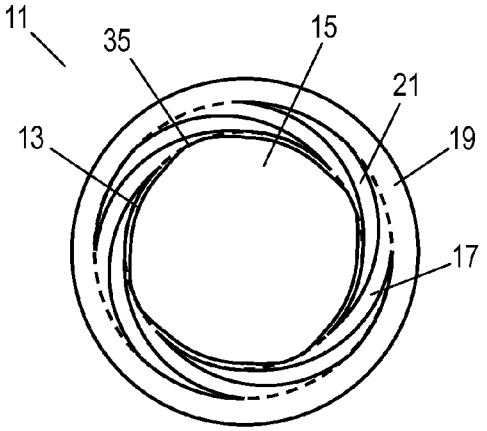
FIG. 9C is a top view of the vibrator of the directional loudspeaker in accordance with the fourth exemplary embodiment.

FIG. 9A is a top view of a piezoelectric element of a vibrator of a directional loudspeaker in accordance with the fourth exemplary embodiment of the present invention. FIG. 9B is a top view of a diaphragm of the vibrator of the directional loudspeaker in accordance with the fourth exemplary embodiment. FIG. 9C is a top view of the vibrator of the directional loudspeaker in accordance with the fourth exemplary embodiment. In this exemplary embodiment, elements similar to those of the first exemplary embodiment have the same reference marks and the detailed description thereof may be omitted.

The characteristic configuration of this exemplary embodiment is the shape of piezoelectric element 15. Piezoelectric element 15 has parts close to corresponding beams 17 in the portions to which beams 17 are fixed, of diaphragm 13, i.e. in the root portions coupled to diaphragm 13, of beams 17. Specifically, this exemplary embodiment has the following configuration. In each of the first through the third exemplary embodiments, piezoelectric element 15 has a circular shape. In contrast, in this exemplary embodiment, as shown by the fine dotted lines in FIG. 9A, parts (in four places) of piezoelectric element 15 are provided with piezoelectric element protrusions 35. Each of piezoelectric element protrusions 35 is a part that protrudes outward from the circular shape (the shape shown by thick dotted lines in FIG. 9A) of piezoelectric element 15 in each of the first through the third exemplary embodiments.

Next, a top view of diaphragm 13 before providing piezoelectric element 15 is shown in FIG. 9B. In this exemplary embodiment, different from each slit 21 in the third exemplary embodiment, each slit 21 is shaped to have a portion along the outer circumference (inner dotted line in FIG. 9B) of diaphragm 13 and have a portion along the inner circumference (outer dotted line in FIG. 9B) of fixed part 19. This is because, in the configuration of this exemplary embodiment, diaphragm 13 is vibrated under the conditions where the possibility of breakage of the root portions of beams 17 is extremely low both at diaphragm 13 and at fixed part 19. Such a configuration can enlarge each slit 21 similarly to those shown in FIG. 4 and FIG. 5, thus enhancing formability of each slit 21 and reducing the cost. Further, the helical shape of each of beams 17 can lengthen beams 17 and enhance the bend of beams 17, thereby increasing the sound pressure due to the lengthened amount.

On the other hand, the portions having no beams 17 and the portions having beams 17 are alternately present along the outer circumference (inner dotted line in FIG. 9B) of diaphragm 13. In the configuration of FIG. 9B, four beams 17 are formed, and thus there are four portions having beams 17 and four portions having no beams 17.

When such diaphragm 13 is vibrated, the portions of the diaphragm having beams 17 and the portions of the diaphragm having no beams are compared. Whereas the latter is a free end, the former is constricted by beams 17. This makes the rigidity in the portions having beams and the portions having no beams different. Therefore, when circular piezoelectric element 15 is used, desired driving characteristics may not be obtained in some specifications of a directional loudspeaker.

Thus, in this exemplary embodiment, when portions having beams 17 and portions having no beams 17 are present along the outer circumference of diaphragm 13, piezoelectric element 15 is disposed close to the portions having beams 17.

That is, when piezoelectric element 15 is formed on diaphragm 13 so that piezoelectric element protrusions 35 of FIG. 9A correspond to the portions having beams 17, piezoelectric element 15 is disposed close to the portions having beams 17 as shown in FIG. 9C. When diaphragm 13 is vibrated by such piezoelectric element 15, piezoelectric element protrusions 35 exert more stresses on beams 17 via the portions having beams 17. This configuration can reduce the non-uniformity of vibration of diaphragm 13 caused by different rigidities, and increase the sound pressure by piezoelectric element protrusions 35. Thus, desired driving characteristics can be obtained.

The above configuration and operation can provide the high reliability described in the first through the third exemplary embodiments, and vibrate even parts which are less likely to vibrate, of diaphragm 13 close to beams 17. Thus, a directional loudspeaker having higher sound pressure can be provided.

Piezoelectric element protrusions 35 described in this exemplary embodiment are not limited to the configuration of vibrator 11 of FIG. 9C, and may be used in the configurations of FIG. 2A, and FIG. 4 through FIG. 8. Piezoelectric element protrusions 35 are preferable, particularly in the configurations of FIG. 2A, and FIG. 4 through FIG. 6, in which the portions having beams 17 and the portions having no beams are clearly present along the outer circumference of diaphragm 13. Piezoelectric element protrusions 35 may be disposed in a configuration where beams 17 and slits 21 have shapes different from those shown in FIG. 2A, and FIG. 4 through FIG. 9C and are arranged in a manner different from those shown in these drawings. Also such a configuration can offer advantages similar to those of the configuration shown in FIG. 9C.

Fifth Exemplary Embodiment

Figure 10:
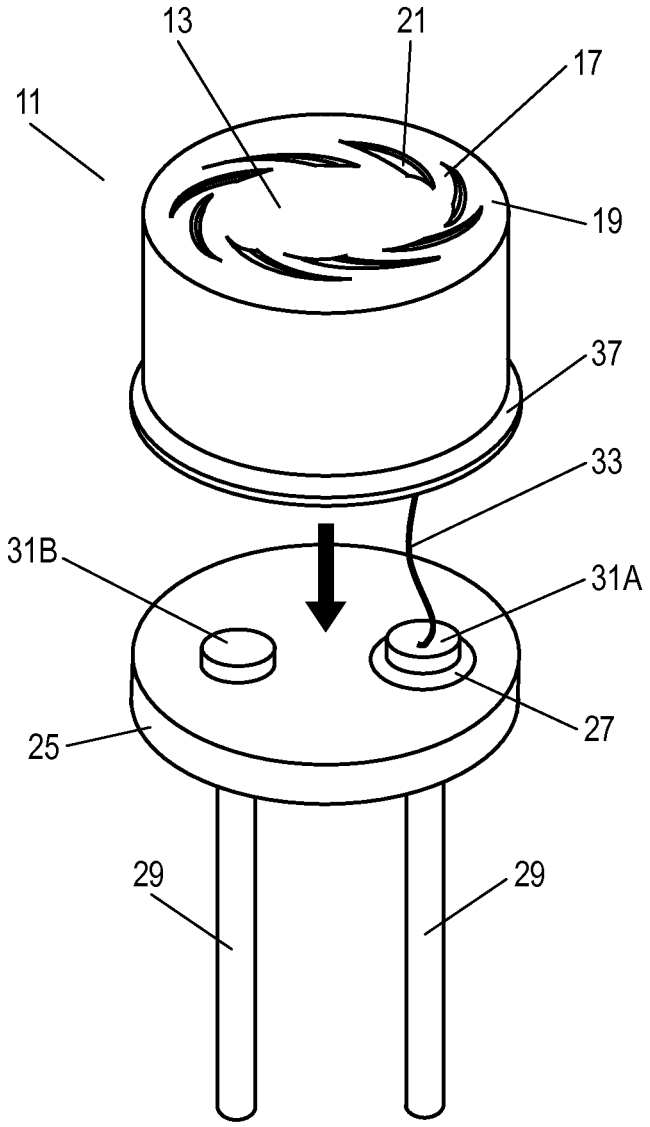
FIG. 10 is an exploded perspective view of a directional loudspeaker in accordance with a fifth exemplary embodiment of the present invention.

FIG. 10 is an exploded perspective view of a directional loudspeaker in accordance with the fifth exemplary embodiment of the present invention. In this exemplary embodiment, elements similar to those of the first exemplary embodiment have the same reference marks and the detailed description thereof may be omitted.

The characteristic configuration of this exemplary embodiment is that vibrator 11 and support 23 in the first exemplary embodiment are integrated into one unit. Specifically, as shown in FIG. 10, diaphragm 13, beams 17, and fixed part 19 are integrally formed on the top face of metallic cap 37, and a piezoelectric element (not shown in FIG. 10) is disposed on the rear face of diaphragm 13. All these elements form vibrator 11. The shapes of diaphragm 13, beams 17, and slits 21 and arrangement thereof are identical with those shown in FIG. 2A. Though not shown in FIG. 10, one end of lead wire 33 is joined to the surface of the piezoelectric element.

The other end of lead wire 33 is connected to terminal 31A. Unlike the configuration of FIG. 1, terminal 31B is fixed directly to metallic base 25 without insulator 27 interposed therebetween. Cap 37 is placed on base 25, and the bent part along the bottom end of cap 37 is welded to base 25. Thereby, cap 37 is electrically connected to one of electrodes 29. As described above, the piezoelectric element is formed on the rear face of diaphragm 13 that is integrally-formed on the top face of cap 37. Therefore, the surface of the piezoelectric element joined to diaphragm 13 is electrically connected to one of electrodes 29. Thus, one lead wire 33 is sufficient. As a result, the possibility of breakage of lead wire 33 is one half of that of the first exemplary embodiment. This increases the reliability. Further, this configuration eliminates the need for support 23, and thus reduces the cost. In addition, disposing lead wire 33 inside cap 37 allows downsizing.

The position of the piezoelectric element is different from that of the first exemplary embodiment, but the other points in the configuration (the shapes of beams 17 and slits 21 and arrangement thereof) are identical with those of FIG. 1 as described above. Thus, similarly to the first exemplary embodiment, this exemplary embodiment can provide the advantage of high sound pressure offered by beams 17.

The above configuration and operation can offer high sound pressure as described in the first exemplary embodiment. Further, in addition to the high reliability offered by the configuration of retaining diaphragm 13 with beams 17, a low possibility of breakage of lead wire 33 allows the directional loudspeaker to have much higher reliability.

In this exemplary embodiment, a configuration including only one lead wire 33 is used. However, similarly to the first exemplary embodiment, a configuration including two lead wires may be used. In this case, the second lead wire 33 connects fixed part 19 or the inside of cap 37 to terminal 31B. Although this configuration makes the possibility of breakage of lead wires 33 equal to that of the first exemplary embodiment, this configuration can provide a directional loudspeaker having high reliability and high sound pressure.

The shapes of beams 17 and slits 21 and arrangement thereof described in this exemplary embodiment are not limited to those shown in FIG. 10, and the configurations described in FIG. 4 through FIG. 9C are applicable. Alternatively, beams 17 and slits 21 may have shapes different from those shown in FIG. 4 through FIG. 9C and may be arranged in a manner different from those shown in these drawings. Such shapes and arrangement can also offer the advantages similar to those shown in FIG. 10.

Also in this exemplary embodiment, the piezoelectric element having piezoelectric element protrusions 35 described in the fourth exemplary embodiment is applicable. This configuration can offer the advantages similar to those of the fourth exemplary embodiment.

Sixth Exemplary Embodiment

Figure 11:
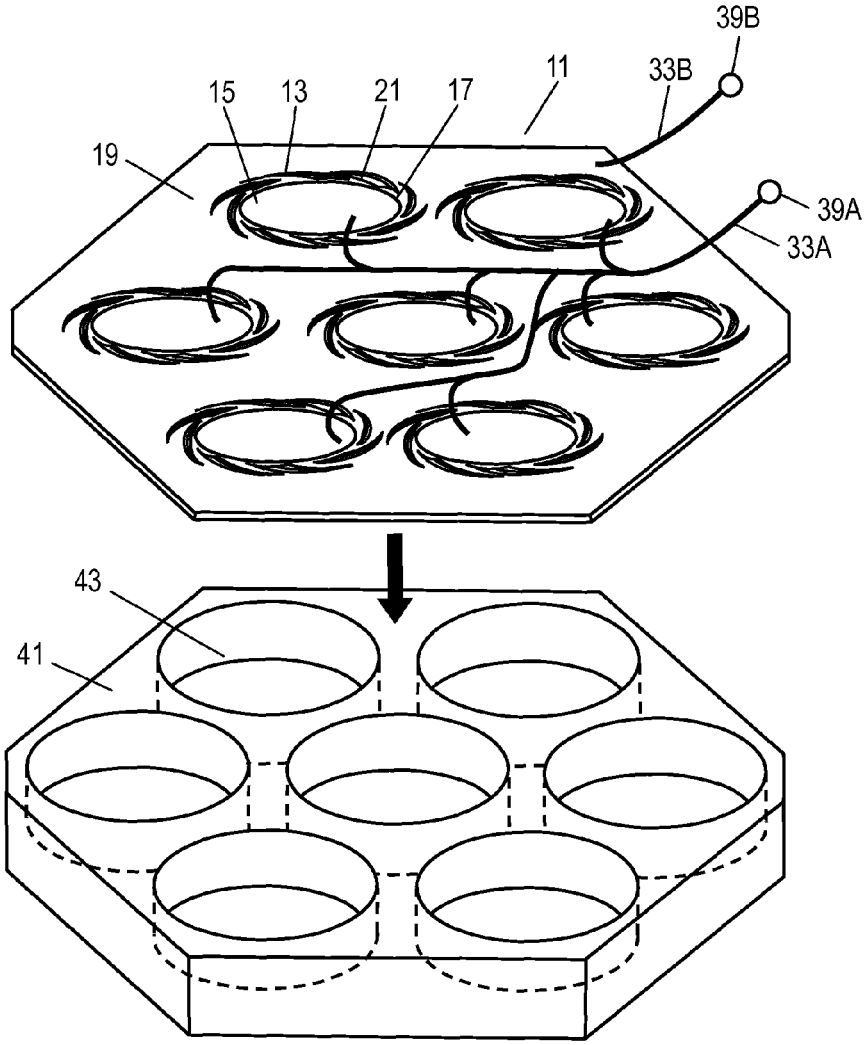
FIG. 11 is an exploded perspective view of a directional loudspeaker in accordance with a sixth exemplary embodiment of the present invention.

FIG. 11 is an exploded perspective view of a directional loudspeaker in accordance with the sixth exemplary embodiment of the present invention. In this exemplary embodiment, elements similar to those of the first exemplary embodiment have the same reference marks and the detailed description thereof may be omitted.

The characteristic configuration of this exemplary embodiment is that a plurality of (seven, herein) diaphragms 13 are integrally formed with beams 17 and slits 21 on one metal plate as a substrate, and piezoelectric element 15 is disposed on the top face of each of diaphragms 13. The whole portion other than diaphragms 13, beams 17, and slits 21 in the metal plate serves as fixed part 19. Thus, in FIG. 11, a plurality of sets of combination of diaphragm 13 and a plurality of beams 17 are disposed on fixed part 19. This metal plate and seven piezoelectric elements 15 form vibrator 11. The shapes of diaphragm 13, beams 17, and slits 21, and arrangement thereof in each set of combination are same as those shown in FIG. 1.

Respective lead wire 33A is connected to each piezoelectric element 15 in vibrator 11, and lead wires 33A are united into one and connected to input terminal 39A. One end of lead wire 33B is electrically connected to a part of fixed part 19 in vibrator 11. The other end of lead wire 33B is electrically connected to input terminal 39B. Such a configuration electrically connects seven piezoelectric elements 15 parallel to each other.

Fixed part 19 of vibrator 11 is fixed to holder 41. Holder 41 has a plurality of (seven in FIG. 11) bottomed cavities 43 each having a diameter equal to that of the inner circumference (e.g. the outer fine dotted line in FIG. 2A) of fixed part 19 formed in the positions opposite corresponding diaphragms 13. The reason why cavities 43 are bottomed is to radiate a sound wave only in one direction (the upper direction in FIG. 11).

When fixed part 19 is fixed to holder 41 in such a configuration, diaphragms 13, beams 17, and slits 21 are placed on virtual planes extended from the top faces of holder 41 at respective cavities 43. Thus, this exemplary embodiment provides a configuration of integrally-forming seven directional loudspeakers described in the first exemplary embodiment, for example. Holder 41 may be made of a metal; however, in this exemplary embodiment, holder 41 does not need to have electrical conductivity, and thus may be made of a resin.

When holder 41 is made of a resin, holder 41 is bonded to fixed part 19 by an adhesive agent. In this case, substantially no vibration is conveyed from diaphragms 13 to fixed part 19, and fixed part 19 can be bonded to all the area of the top face of holder 41 without cavities 43. This can reduce the possibility of peeling-off. Thus, holder 41 made of a resin can also offer high reliability. Further, for holder 41 made of a resin, cavities 43 can be formed by injection molding and thus the cost can be reduced.

In contrast, holder 41 made of a metal can be welded to fixed part 19 of vibrator 11 and this can offer much higher reliability. Further, when lead wire 33B connected to fixed part 19 is thrust into thick holder 41 for secure connection, the possibility of breakage of lead wire 33B can be reduced and this can also offer high reliability. Therefore, in view of the required reliability and cost, it is only necessary to select a material optimum as holder 41 appropriately.

In such a directional loudspeaker, when a signal obtained by modulating an audible sound signal with a carrier wave in the ultrasonic wave band is input from input terminals 39A and 39B to seven piezoelectric elements 15, individual diaphragms 13 having piezoelectric elements 15 vibrate. As a result, a highly-directional sound wave radiates from seven places to the same direction (the upper direction in FIG. 11), and thereby audio information with high sound pressure can be transmitted only to a specific subject.

With the above configuration and operation, the structure of retaining diaphragms 13 with beams 17 can offer high reliability, and the bend of beams 17 can enhance the sound pressure in each of diaphragms 13. Thereby, a directional loudspeaker with much higher sound pressure can be provided.

In this exemplary embodiment, seven diaphragms 13 are disposed. However, the number is not limited to seven and may be changed so that required sound pressure can be obtained. The external shape of vibrator 11 and holder 41 is not limited to an octagon as shown in FIG. 11, and may be any shape, such as a circle.

The shapes of beams 17 and slits 21 and arrangement thereof described in this exemplary embodiment are not limited to the configuration shown in FIG. 11, and the configurations described in FIG. 4 through FIG. 9C are applicable. Alternatively, beams 17 and slits 21 may have shapes different from those shown in FIG. 4 through FIG. 9C and may be arranged in a manner different from those shown in these drawings. Such shapes and arrangement can also offer the advantages similar to those of the configuration shown in FIG. 11.

Also in this exemplary embodiment, piezoelectric element 15 having piezoelectric element protrusions 35 described in the fourth exemplary embodiment is applicable. This configuration can also offer the advantages similar to those of the fourth exemplary embodiment.

Also in the second through the sixth exemplary embodiments, as described in the first exemplary embodiment, piezoelectric elements 15 may be formed on both faces of diaphragm 13, or piezoelectric elements 15 may be laminated. With those configurations, the sound pressure can be further enhanced and piezoelectric elements 15 can be driven at a low voltage.

The exemplary embodiments described above can provide a directional loudspeaker with high reliability and high sound pressure where the possibility of peeling-off of diaphragm 13 is reduced. That is, diaphragm 13 is fixed to fixed part 19 via a plurality of beams 17 formed in at least part of the outer circumference of diaphragm 13. With this configuration, diaphragm 13 is retained by beams 17. Thus, beams 17 can bend in response to vibration of diaphragm 13. Therefore, it is unnecessary to use the conventional configuration including the bend of the free end of diaphragm 13, in which the sound pressure is ensured by using an insulating adhesive agent. This eliminates the need for the use of the insulating adhesive agent, which enhances the reliability. Further, the bend of beams 17 allows vibration of entire diaphragm 13 even through diaphragm 13 is retained by beams 17. This configuration can offer high sound pressure. Therefore, a directional loudspeaker having high reliability and high sound pressure can be provided.

INDUSTRIAL APPLICABILITY

The present invention can provide a directional loudspeaker that has high reliability and high sound pressure, and is especially useful as a directional loudspeaker that transmits audio information only to a specific subject.

The invention claimed is:

1. A directional loudspeaker comprising a vibrator including:

a diaphragm having a circular shape;

a piezoelectric element disposed on at least one of a top face and a bottom face of the diaphragm;

beams disposed in at least a part of an outer circumference of the diaphragm; and a fixed part disposed outside the beams, wherein:

slits are formed by adjacent two of the beams and at least one of the diaphragm and the fixed part, and the beams form a helical shape from the diaphragm to the fixed part.

2. The directional loudspeaker according to claim 1, wherein the diaphragm, the beams, and the fixed part are integrally formed.

3. The directional loudspeaker according to claim 1, wherein a distance between portions fixed to the diaphragm, of adjacent two of the beams, is substantially zero within a fixing accuracy of each of the beams to the diaphragm.

4. The directional loudspeaker according to claim 1, wherein a distance between portions fixed to the fixed part, of the adjacent two of the beams, is substantially zero within a fixing accuracy of each of the beams to the fixed part.

5. The directional loudspeaker according to claim 1, wherein protrusions are provided on the piezoelectric element so as to correspond to portions, to which the beams are fixed, of the diaphragm.

6. The directional loudspeaker according to claim 1, wherein sets of combination of the diaphragm and the beams are formed on one substrate, and the substrate is the fixed part.

7. The directional loudspeaker according to claim 1, wherein:

each of the slits are defined by three lines, and one of the three lines is a part of the outer circumference of the circular shape of the diaphragm.

8. The directional loudspeaker according to claim 7, wherein remaining two lines of the three lines are curved.

9. The directional loudspeaker according to claim 1, wherein each of the slits is defined by two curved lines.

10. The directional loudspeaker according to claim 1, wherein:

an inner circumference of the fixed part has a circular shape, each of the slits are defined by three lines, and one of the three lines is a part of the inner circumference of the circular shape of the fixed part.

11. The directional loudspeaker according to claim 10, wherein remaining two lines of the three lines are curved.

12. A directional loudspeaker comprising a vibrator including:

a diaphragm having a circular shape;

a piezoelectric element disposed on at least one of a top face and a bottom face of the diaphragm;

beams disposed in at least a part of an outer circumference of the diaphragm; and a fixed part disposed outside the beams, wherein:

slits are formed by adjacent two of the beams and at least one of the diaphragm and the fixed part, each of the slits is defined by three or four lines, and a length of each of the beams is longer than a distance between the diaphragm and the fixed part.

13. The directional loudspeaker according to claim 12, wherein:

an inner circumference of the fixed part has a circular shape, each of the slits are defined by four lines, one of the four lines is a part of an outer circumference of the circular shape of the diaphragm, and one of the four lines is a part of the inner circumference of the circular shape of the fixed part.

14. The directional loudspeaker according to claim 13, wherein remaining two lines of the four lines are straight.

15. The directional loudspeaker according to claim 12, wherein:

at least one of the slits are defined by three lines, and one of the three lines is a part of an outer circumference of the circular shape of the diaphragm.

16. The directional loudspeaker according to claim 15, wherein remaining two lines of the three lines are straight.

17. The directional loudspeaker according to claim 12, wherein:

an inner circumference of the fixed part has a circular shape, at least one of the slits are defined by three lines, and one of the four lines is a part of the inner circumference of the circular shape of the fixed part.

18. The directional loudspeaker according to claim 17, wherein remaining two lines of the three lines are straight.

19. The directional loudspeaker according to claim 12, wherein an angle of each beam against the outer circumference of the diaphragm is inverted alternately.

20. A directional loudspeaker comprising a vibrator including:

a diaphragm having a circular shape;

a piezoelectric element disposed on at least one of a top face and a bottom face of the diaphragm;

beams disposed in at least a part of an outer circumference of the diaphragm; and a fixed part disposed outside the beams, wherein:

slits are formed by adjacent two of the beams and at least one of the diaphragm and the fixed part, each of the beams has a clank shape, an inner circumference of the fixed part has a circular shape, each of the slits is defined by adjacent beams, a part of an outer circumference of the circular shape of the diaphragm and a part of the inner circumference of the circular shape of the fixed part.

* * * * *